US006792785B2

(12) United States Patent
Kinoshita

(10) Patent No.: US 6,792,785 B2
(45) Date of Patent: Sep. 21, 2004

(54) CONTACT SURFACE STRUCTURE OF BENDING DIE

(75) Inventor: Tadatoshi Kinoshita, Tokyo (JP)

(73) Assignee: Yourbusiness Co., Ltd., Tokyo (JP)

( * ) Notice: Subject to any disclaimer, the term of this patent is extended or adjusted under 35 U.S.C. 154(b) by 0 days.

(21) Appl. No.: 10/336,288

(22) Filed: Jan. 3, 2003

(65) Prior Publication Data

US 2004/0129050 A1 Jul. 8, 2004

(51) Int. Cl.[7] ..... B21D 5/04
(52) U.S. Cl. ..... 72/320; 72/386
(58) Field of Search ..... 72/386, 387, 420, 72/321, 320, 319, 322, 466, 478

(56) References Cited

U.S. PATENT DOCUMENTS 2,526,489 A * 10/1950 Liddicoat ..... 72/344
3,662,584 A * 5/1972 Jones et al. ..... 72/411
4,660,402 A * 4/1987 Hongo ..... 72/389.4
5,341,669 A * 8/1994 Katz ..... 72/387
6,038,908 A 3/2000 Kinoshita

* cited by examiner

*Primary Examiner*—Daniel C. Crane
(74) *Attorney, Agent, or Firm*—Andrus, Sceales, Starke & Sawall, LLP

(57) ABSTRACT

The present invention provides a bending die in which the fixed die 1 and the rotary die 2 are surface contacted to each other, the rotary die 2 is rotated rearward after press forming to cause the workpiece 3 to be moved away from the die, wherein the contact surface 9 between the fixed die 1 and the rotary die 2 is formed in a flat surface. In addition, the present invention is set such that the rotary center point P of the rotary die 2 is set outside the line 10 drawn from one end C1 of the linear line indicating the contact surface 9 of the rotary die 2 in a direction of right angle in respect to the linear line when the contact surface 9 is seen in a section of a direction perpendicular to the axis of the rotary die 2. With such an arrangement as above, a machining of the contact surface 9 can be facilitated more and under a lower cost than those as compared with those forming the arcuate surface as found in the prior art.

2 Claims, 4 Drawing Sheets

CONTACT SURFACE STRUCTURE OF BENDING DIE

BACKGROUND OF THE INVENTION (1) Field of the Invention

This invention relates to a bending die having a fixed die and a rotary die, and more particularly a bending die contact surface structure in which the contact surface can be easily formed.

(2) Description of the Related Art

In the case that the workpiece 3 is press formed into a state having a machined curve line segment 14 as indicated in FIG. 5, for example, the bending die (a press forming device) as shown in FIG. 3 is used (refer to the gazette of U.S. Pat. No. 6,038,908, for example).

This bending die is comprised of a fixed die 1 and a rotary die 2, wherein the rotary die 2 is rotated around a center of the rotary center point P while being contacted with the fixed died 1 at an arcuate surface 15. A metallic thin plate acting as the workpiece 3 is mounted at a mounting surface 8 formed when the fixed die 1 and the rotary die 2 are contacted to each other in such a way that its right end protrudes and the workpiece is pressed from above with the pressing die 4 having the same curved surface as the mounting surface 8. Under this state, the slide cam 5 slides in a leftward direction as viewed in the figure, and the near bending blade 6 is forcedly pressed against the near bending blade receptor 7 of the rotary die 2 as shown in FIG. 4. Then, after forming operation, the slide cam 5 retracts in a rightward direction and the press die 4 ascends. After this operation, the rotary die 2 is rotated toward the rotating direction R (see FIG. 3) as indicated by a dotted line in FIG. 4 and then the rotary die is pulled away from the forming location of the workpiece 3. With such an arrangement as above, a press formed product having a sectional shape as shown in FIG. 5 can be produced.

Thus, as described above, the prior art bending die was constituted such that the fixed die 1 and the rotary die 2 are contacted at the arcuate surface 15 and rotated. Due to this fact, it was necessary in the prior art that the arcuate surface 15 of the fixed die 1 was formed into a concave curved shape and the arcuate surface 15 of the rotary die 2 was formed into a convex curved shape. Further, in this case, it was necessary that both arcuate surfaces 15 should be machined in a quite high accuracy for enabling the rotary die 2 to be rotated smoothly and formed in a high precision manner.

However, such a machining process as described above requires a special expensive machining device, resulting in that the number of machining steps is increased and requires a troublesome work or high cost.

In addition, in the case that the workpiece 3, for example, is formed into such a state as one in which its machining curved lines (curved degrees) over its longitudinal direction are different at positions of a vertical direction as shown in FIG. 3, it is necessary that a radius ranging from the rotary center point P to the arcuate surface 15. However, a continuous formation of arcuate surfaces 15 having different radii described above to a set of fixed die 1 and rotary die 2 over an axial direction of the rotary die 2 was accompanied by a(complex procedure and a large number of machining steps, resulting in that it required a quite large number of troublesome operations and a high cost.

The present invention has been proposed in view of the aforesaid problems found in the prior art.

Accordingly, the technical subject matter of the present invention is to provide a bending die contact surface structure in which a contact surface between the fixed die and the rotary die can be machined easily and at a low cost by a general-purpose type machining apparatus and further the contact surface is formed in such a way that it may not provide any trouble in a rotating operation of the rotary die.

SUMMARY OF THE INVENTION

As shown in FIG. 1, the present invention provides a bending die contact surface structure in which the fixed die 1 and the rotary die 2 are surface contacted to each other, the rotary die 2 is turned in a rearward direction after press forming operation to cause the workpiece 3 to be moved away from the die. The contact surface 9 between the fixed die 1 and the rotary die 2 is formed in a flat surface. When this contact surface 9 is seen at a section in a direction perpendicular to the axis of the rotary die 2, the rotary center point P of the rotary die 2 is set outside the line 10 drawn from the one end C1 of the linear line indicating the contact surface 9 of the rotary die 2 in a direction perpendicular to the linear line. With this arrangement above, the present invention is made such that the rotary die 2 is formed in such a way that it can be rotated toward the other end C2 of the aforesaid linear line 2.

In the present invention, a thin metallic plate, for example, acting as the workpiece 3 is mounted on the mounting surface 8 formed by the fixed die 1 and the outer surface of the rotary die 2, then the pressing die 4 is pressed against it to fix the workpiece 3, and after this operation, the slide cam 5 is slid to cause the thin plate to be bent. In this case, the thin plate is formed by the over-hang near bending blade receptor 7 formed at the rotary die 2 in such a way that it may be bitten inside itself. Then, the rotary die 2 is turned around the rotary center point P while being turned to the rotating direction R as viewed in the figure and the workpiece 3 is released from the die.

In the case of the present invention, the rotary center point P is set outside (the right side in the figure) the line 10 drawn from the one end C1 (the right end in the figure) of the linear line indicating the contact surface 9 of the rotary die 2 in a direction perpendicular to the linear line as described above. Accordingly, a distance ranging from the rotary center point P to the other end C1 becomes shorter than that of any location on the linear line indicating the contact surface 9 abutting against the left side of the one end C1.

That is, when the rotary center point P is set outside the line 10 (the right side in the figure), the arcuate lotus 11 (see FIG. 2) drawn by the one end C1 around the rotary center point P does not cross with the linear line indicating the contact surface 9 at the left side of the one end C1. Due to this fact, in the present invention, the rotary die 2 can be rotated toward the rotating direction R.

In other words, as shown in FIG. 2, when the rotary center point P1 is placed inside (the left side) of the line 10 in the present invention, the arcuate lotus 12 drawn by the one end C1 around the rotary center P1 enters into the fixed die 1 at the left side of the one end C1. That is, when the rotary center point P1 is set inside the line 10, its rotation in a counter-clockwise direction becomes impossible. In addition, in this case, the arcuate lotus 13 drawn by the other end C2 enters into the fixed die 1 at the right side of the other end C2. Accordingly, when the rotary center point P1 is set inside the line 10, its rotation in a clockwise direction may also become impossible.

Thus, in the case of the present invention, the right end of the fixed die 1 may also occupy the same position as that of the one end C1 of the contact surface 9 as shown in FIG. 1 or it may be protruded from the one end C1 in the rightward direction as shown in FIG. 2. If the contact surface 9 satisfies the condition in which the rotary center point P is set outside the line 10, it may also be applicable that it is formed to be lowered at the left side from the one end C1.

In the present invention, the rotary die 2 can be rotated even if the contact surface 9 between the fixed die 1 and the rotary die 2 is formed to be flat under the aforesaid principle.

Then, in accordance with this arrangement, it is satisfactory if the contact surface between the fixed die and the rotary die is machined flat, the contact surface can be machined by a general-purpose machining apparatus in an easy, fast and low cost manner without using any expensive machining apparatus.

Further, since the contact surface 9 in the present invention is in a flat surface state, when a plurality of the contact surfaces 9 having different distances (rotating radii) from the rotary center point P to the one end C1 are formed over the axial direction of the rotary die 2, it is possible to reduce or decrease a troublesome machining operation or its cost.

DESCRIPTION OF THE PREFERRED EMBODIMENT

Figure 1:
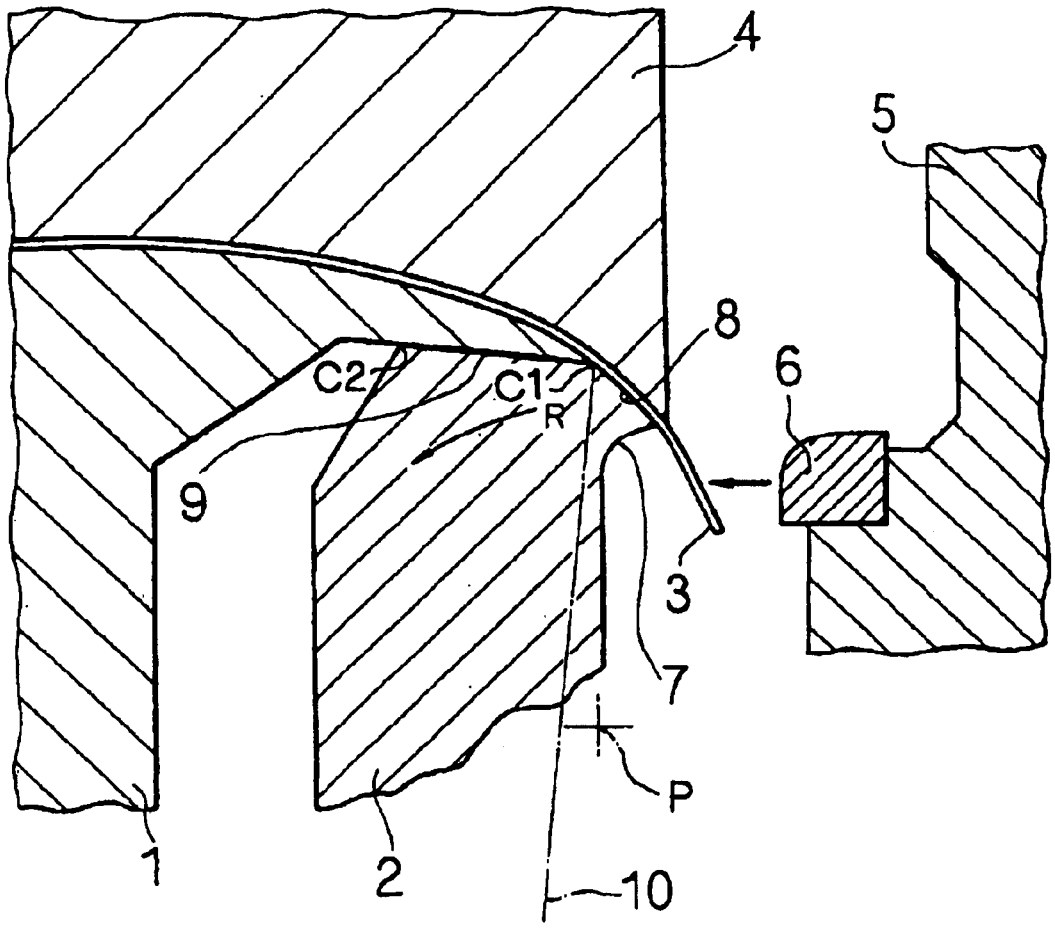
FIG. 1 is a substantial segment longitudinal section for showing one preferred embodiment of the present invention.

Referring now to the drawings, one preferred embodiment of the present invention will be described as follows.

As shown in FIG. 1 and the like, the present invention is a bending die in which a fixed die 1 and a rotary die 2 are contacted at their faces, the rotary die 2 is turned rearward after press forming operation to cause a workpiece 3 to be moved away from the die. Reference numeral 4 denotes a pressing die, reference numeral 5 denotes a slide cam and reference numeral 6 denotes a near bending blade arranged at a front end of the slide cam 5. The rotary die 2 is formed with an over-hang type near bending blade receptor 7 at a position corresponding to the near bending blade 6. A thin metallic plate acting as the workpiece 3 is mounted on a mounting surface 8 formed when the fixed die 1 and the rotary die 2 are contacted to each other, and then the thin metallic plate is fixed by the pressing die 4.

The contact surface 9 between the fixed die 1 and the rotary die 2 is formed as a flat surface. In the case that this contact surface 9 is seen at a sectional surface (meaning a sectional surface shown in FIG. 1) perpendicular to an axis of the rotary die 2, a rotary center point P of the rotary die 2 is set outside a line 10 drawn from one end C1 of a linear line indicating the contact surface 9 in a right angle direction in respect to the above linear line. With such an arrangement as above, the rotary die 2 in the present invention can be turned to a side of the other end C2 of the linear line indicating the contact surface 9 (the side in a rotating direction R).

An action of the present invention will be described as follows.

A thin plate acting as the workpiece 3 is mounted on the mounting surface 8, the pressing die 4 descends and the thin plate is fixed to the mounting surface 8. Under this state, the slide cam 5 slides in a leftward direction as viewed in the figure and the near bending blade 6 is pushed against the near bending blade receptor 7 of the rotary die 2. As a result, the portion at the right end of the thin plate is bent in such a way that it is bitten inside the plate itself. After this operation, the slide cam 5 retracts and after the pressing die 4 ascends, the rotary die 2 is rotated toward the rotating direction R. With this operation, the over-hang near bending blade receptor 7 of the rotary die 2 is pulled away from the workpiece 3, and the workpiece 3 can be taken out in an upward direction or the like. A pressing pressure of the slide cam 5 applied to the rotary die 2 is received by the fixed die 1 and the like.

Figure 2:
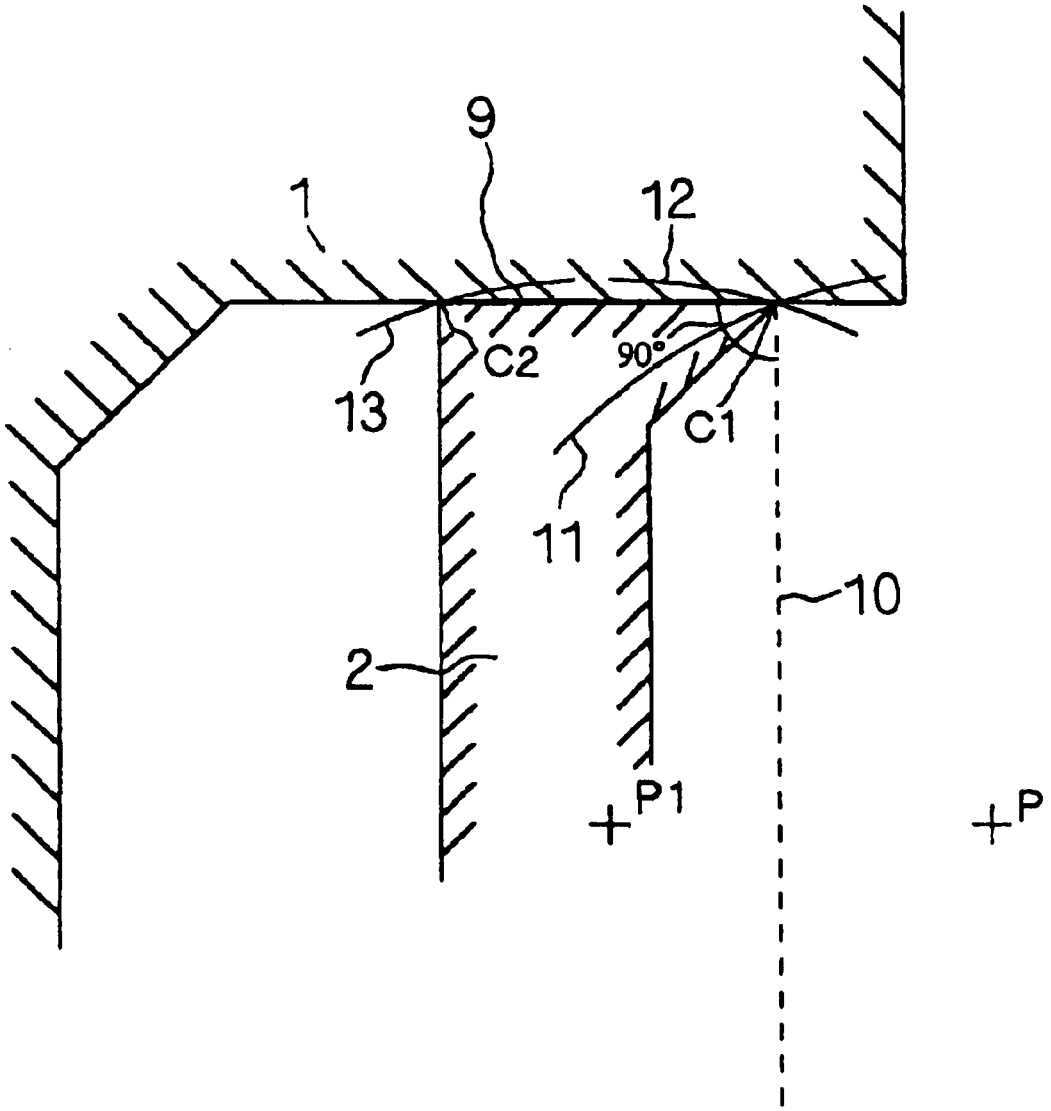
FIG. 2 is a substantial segment longitudinal section for illustrating a principle of the present invention.
Figure 3:
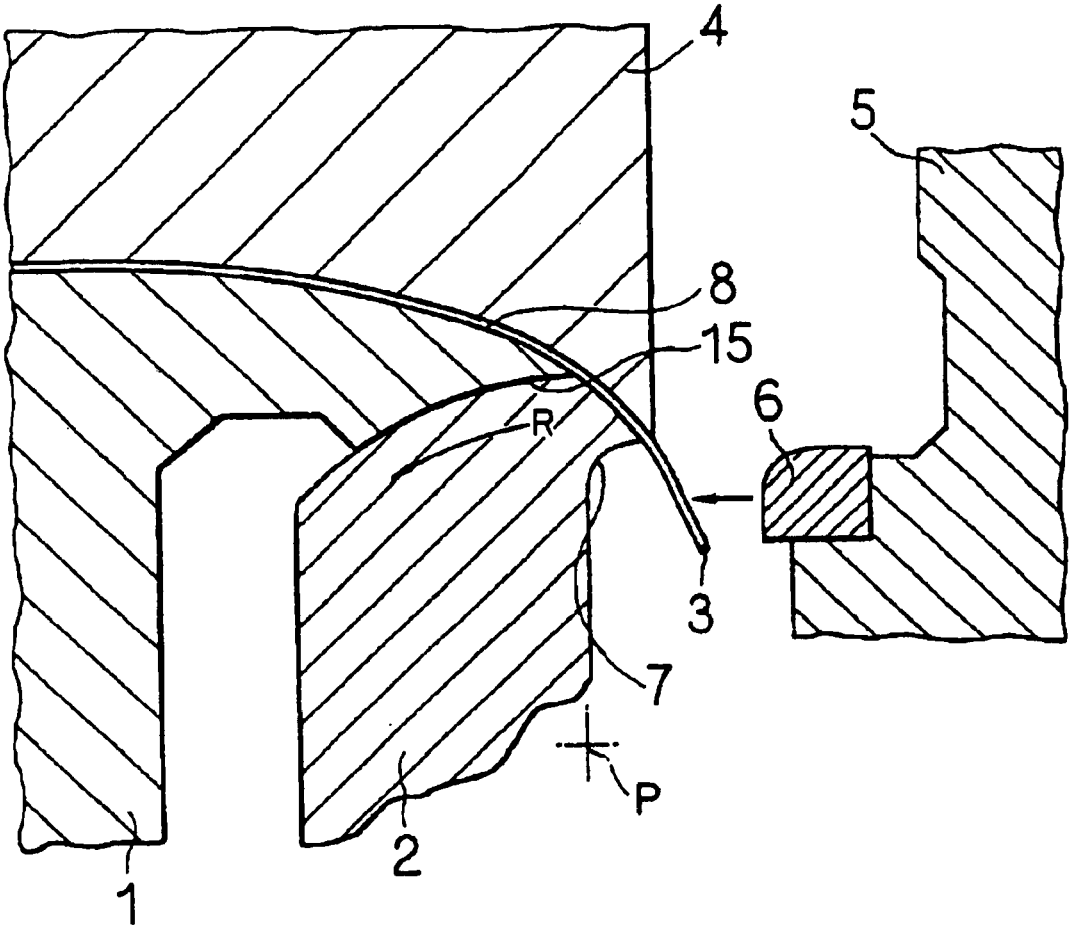
Fig. 3 Prior Art
FIG. 3 is a substantial segment longitudinal section for showing the prior art.
Figure 4:
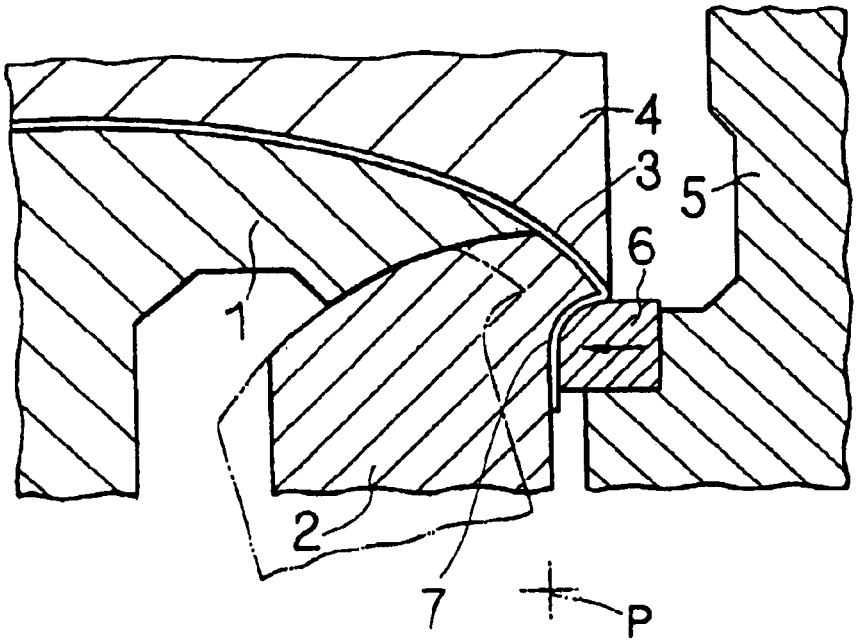
Fig. 4 Prior Art
FIG. 4 is a substantial segment longitudinal section for illustrating a pressing action in the prior art.
Figure 5:
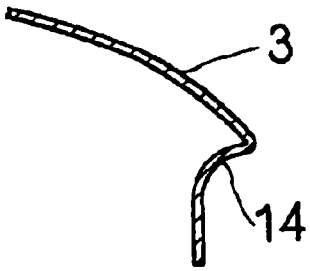
Fig. 5 Prior Art
FIG. 5 is a substantial segment longitudinal section for showing a press formed workpiece.

In this way, the rotary center point P in the case of the present invention is set outside (the right side in the figure) the line 10 drawn from one end CL of the linear line (the right end in the figure) indicating the contact surface 9 in a direction perpendicular to the linear line as described above. Accordingly, since the one end C1 of the rotary die 2 draws an arcuate lotus 11 (see FIG. 2) around a center of the rotary center point P, when the rotary die 2 is rotated toward the rotating direction R, one end $C_1$ is not crossed with the linear line indicating the contact surface 9. Due to this fact, the rotary die 2 in the present invention can be rotated toward the rotating direction R.

What is claimed is:

1. A bending die contact surface structure in which a fixed die and a rotary die are surface contacted to each other and together join to form a mounting surface for a workpiece, the mounting surface being divided by the contact surface, the rotary die is rotated rearward after press forming to cause the workpiece to be moved away from the rotary die, wherein the contact surface between the fixed die and the rotary die is formed in a flat plane, a rotary center point of the rotary die is set outside a line drawn from and perpendicular to one end of a linear line on the contact surface of the rotary die in a plane perpendicular to an axis of the rotary die, the rotary die is rotatable directly from the position of surface contact with the fixed die toward the other end of said linear line, the other end being on the contact surface.

2. A bending die contact surface structure according to claim 1, wherein a plurality of contact surfaces having a different distance from the rotary center point to one end are formed in a direction of the axis of the rotary die.

* * * * *